US008316787B2

(12) United States Patent
Back

(10) Patent No.: US 8,316,787 B2
(45) Date of Patent: Nov. 27, 2012

(54) BRAKING SYSTEM FOR WATERCRAFT

(76) Inventor: Larry Douglas Back, New Albany, OH (US)

( * ) Notice: Subject to any disclaimer, the term of this patent is extended or adjusted under 35 U.S.C. 154(b) by 189 days.

(21) Appl. No.: 12/854,997

(22) Filed: Aug. 12, 2010

(65) Prior Publication Data

US 2012/0037064 A1 Feb. 16, 2012

(51) Int. Cl.
*B63B 1/32* (2006.01)

(52) U.S. Cl. ..... 114/289

(58) Field of Classification Search ..... 114/284–290, 114/145 R; 440/38–43
See application file for complete search history.

(56) References Cited

U.S. PATENT DOCUMENTS

| | | | | |
|---|---|---|---|---|
| 1,548,936 | A | | 8/1925 | DuMont |
| 2,356,301 | A | * | 8/1944 | Brase ..... 440/40 |
| 2,884,889 | A | | 5/1959 | Jorg et al. |
| 3,259,096 | A | * | 7/1966 | Bowles ..... 114/151 |
| 3,611,972 | A | | 10/1971 | Duport |
| 3,800,731 | A | | 4/1974 | Slade |
| 3,865,067 | A | | 2/1975 | Archer |
| 4,056,073 | A | | 11/1977 | Dashew et al. |
| 4,265,192 | A | | 5/1981 | Dunn |
| 4,694,770 | A | | 9/1987 | Kitner et al. |
| 4,807,552 | A | | 2/1989 | Fowler |
| 5,092,260 | A | | 3/1992 | Mardikian |
| 5,129,846 | A | | 7/1992 | Dimijian |
| 5,193,478 | A | | 3/1993 | Mardikian |
| 5,377,610 | A | | 1/1995 | Goebel |
| 5,494,464 | A | | 2/1996 | Kobayashi et al. |
| 5,755,601 | A | | 5/1998 | Jones |
| 5,813,357 | A | | 9/1998 | Watson |
| 5,934,954 | A | | 8/1999 | Schott et al. |
| 6,146,219 | A | | 11/2000 | Blanchard |
| 6,158,371 | A | | 12/2000 | De Risi |
| 6,171,159 | B1 | | 1/2001 | Shen et al. |
| 6,305,307 | B1 | | 10/2001 | Yokoya |
| 6,428,370 | B1 | | 8/2002 | Jones |
| 6,547,611 | B1 | | 4/2003 | Boroos et al. |
| 6,691,634 | B2 | | 2/2004 | Fritchle |
| 6,722,932 | B2 | | 4/2004 | Yanagihara |
| 6,743,062 | B1 | | 6/2004 | Jones |
| 7,007,621 | B1 | | 3/2006 | Bootes |
| 7,188,577 | B2 | | 3/2007 | Colyvas |
| 7,217,165 | B2 | | 5/2007 | Roos |

* cited by examiner

*Primary Examiner* — Daniel Venne
(74) *Attorney, Agent, or Firm* — James R. Eley; Michael A. Forhan; Eley Law Firm Co., LPA

(57) ABSTRACT

A braking system for a watercraft moving upon a body of water. A hull has a bow portion, a bottom portion and a port opening in the bow. A water inlet is formed in the bottom of the hull. A duct extends between the water inlet and the port opening. A generally U-shaped hub has an intake portion and an output portion. The hub is selectably movable between a stowed position with the intake portion within the hull and a deployed position with the intake portion extending into the body of water. The intake portion of the hub, when deployed, diverts water from the intake portion to the output portion of the hub. The moving watercraft is braked by drag induced upon the hull by the deployed hub extending into the body of water and by the diverted water urged through the duct and out of the port opening.

20 Claims, 8 Drawing Sheets

BRAKING SYSTEM FOR WATERCRAFT

FIELD

The present invention relates generally to watercraft, in particular to a braking system for slowing and stopping watercraft.

BACKGROUND

Watercraft such as inboard or outboard motor boats are capable of reaching relatively high speeds. When an operator desires to reduce the speed of the boat he or she simply reduces the throttle setting of the motor, allowing drag induced by water flowing past the hull to gradually slow the boat.

However, there is often a need to rapidly slow a relatively fast-moving boat, such as to avoid an obstruction in the water or other boats operating nearby. To accomplish this some boats incorporate selectably actuated thrusters that take in water around the boat and generate a high-pressure jet of water. The jet is directed in a direction opposing the direction of travel of the boat, the thrust generated by the jet acting counter to the forward motion of the boat. A significant drawback of thrusters is that they are complex, requiring expensive, heavy pumping systems and controls for operation.

Another means for braking boats involves the use of generally planar "braking boards," selectably actuated drag-inducing devices located at the stern of the boat that are deployed below the waterline when it is desired to slow the boat. While effective, braking boards can cause the stern of the boat to dip significantly when actuated, reducing the stability of the boat and possibly upsetting passengers or shifting cargo. In addition, braking boards typically are rigid and are thus subject to significant force when deployed. Because of this force, braking boards must be made of strong, expensive materials.

SUMMARY

An object of the present invention is a braking system for a watercraft moving upon a body of water. A hull has a bow portion and a bottom portion. A port opening is formed in the bow portion of the hull. A water inlet is formed in the bottom portion of the hull. A duct extends between the water inlet and the port opening. A generally U-shaped hub has an intake portion and an output portion. The hub is selectably movable between a stowed position with the intake portion within the hull and a deployed position with the intake portion extending into the body of water and away from the bottom of the hull. The intake portion of the hub, when deployed, diverts water from the intake portion to the output portion of the hub and into the duct, the diverted water further being urged at high pressure through the duct and out of the port opening by the flowing water. The moving watercraft is braked by drag induced upon the hull by the deployed hub extending into the body of water and by the diverted water urged out of the port opening.

Another object of the present invention is a method for braking a watercraft moving upon a body of water. The method comprises the steps of providing a hull having a bow portion and a bottom portion, and forming a port opening in the bow portion of the hull. A water inlet is formed in the bottom portion of the hull. A duct is extended between the water inlet and the port opening. A generally U-shaped hub is also provided, the hub having an intake portion and an output portion, the output portion being proximate the duct. The hub is selectably movable between a stowed position with the intake portion within the hull and a deployed position with the intake portion extending into the body of water and away from the bottom of the hull. The intake portion of the hub, when deployed, diverts water from the intake portion to the output portion of the hub and into the duct, the diverted water further being urged at high pressure through the duct and out of the port opening by the flowing water. The moving watercraft is braked both by the drag induced upon the hull by the deployed hub extending into the body of water and by the diverted water urged out of the port opening.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
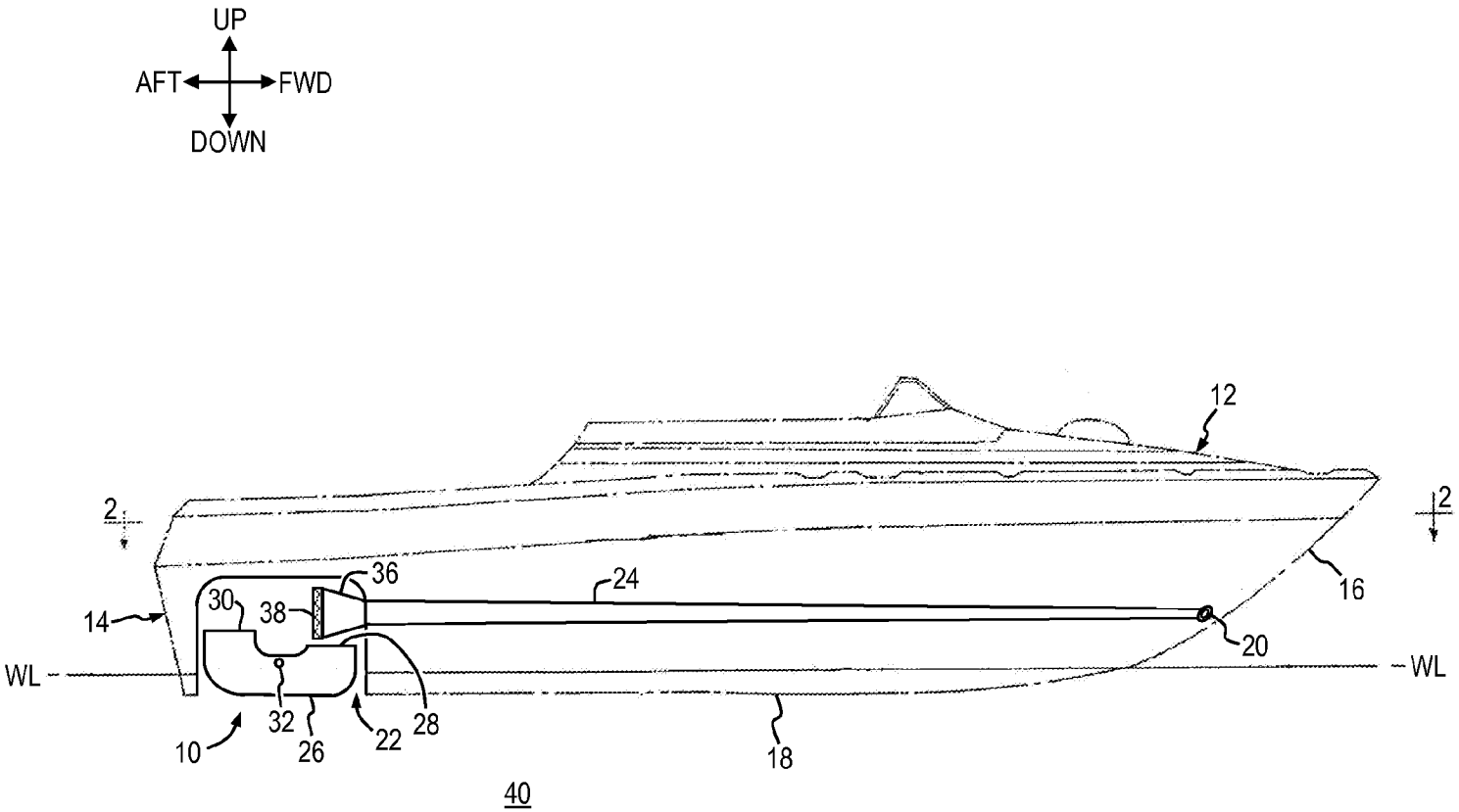
FIG. 1 shows an elevational view of a braking system for a watercraft according to an embodiment of the present invention.

In the discussion that follows, like reference numerals are used to describe like elements in the various figures and embodiments. Furthermore, the elements in the various figures are not necessarily to scale.

Figure 2:
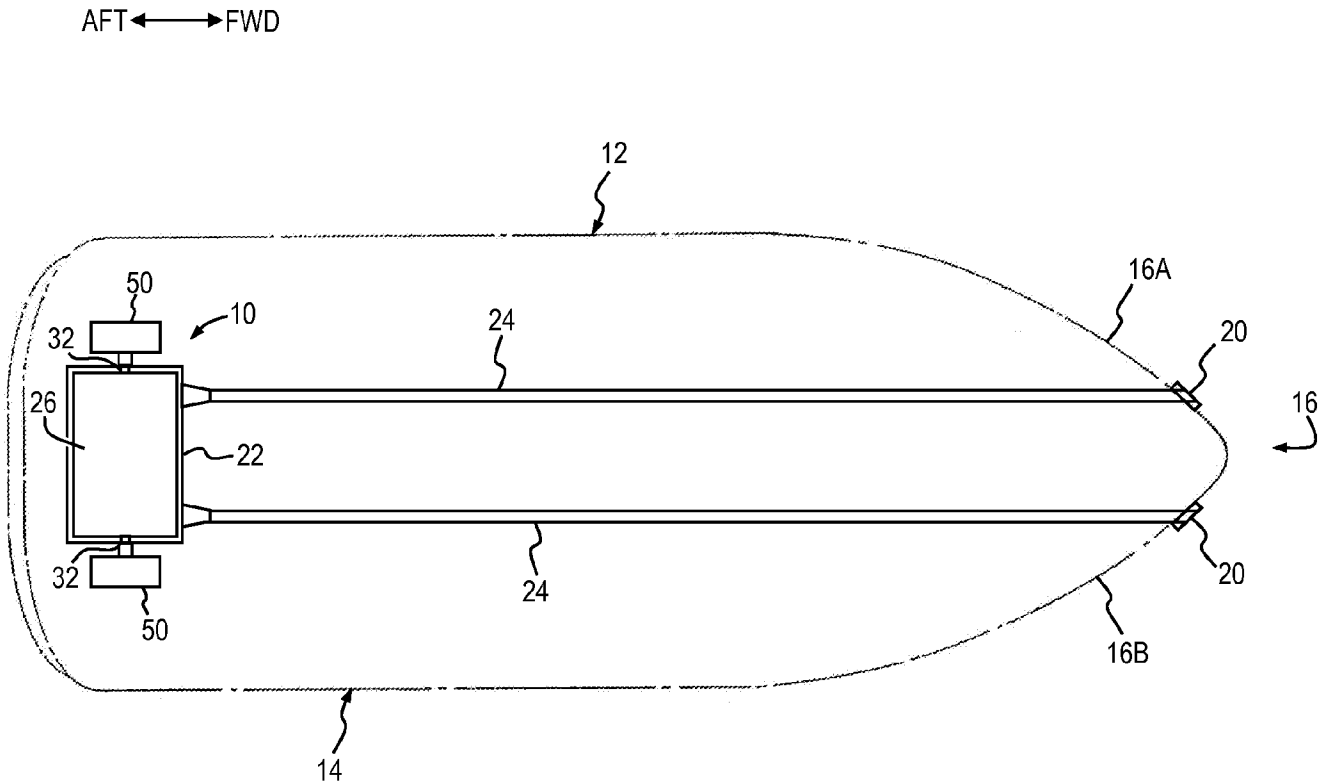
FIG. 2 is a top plan view of the system of FIG. 1.
Figure 3:
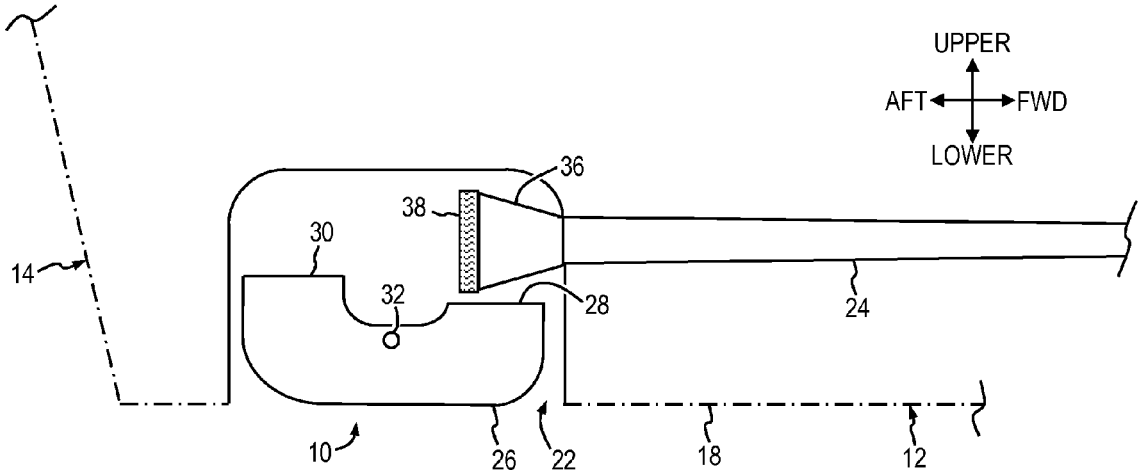
FIG. 3 is an expanded view of the braking system of FIG. 1.

The general arrangement of a braking system 10 for a watercraft 12 is shown in FIGS. 1 through 3 according to an embodiment of the present invention. Watercraft 12 has a hull 14 with a bow portion 16 having opposing bow faces 16A, 16B. Hull 14 further includes a bottom portion 18. At least one port opening 20 is formed in bow portion 16. In addition, a water inlet 22 is formed in the bottom portion 18 of the hull 14. One or more ducts 24 extend between water inlet 22 and port opening 20. A generally U-shaped hub 26 having an intake portion 28 and an output portion 30 is disposed in water inlet 22 with the output portion proximate duct 24. Hub 26 may be pivotably attached to hull 14 in any suitable manner, such as with a pivot pin or rod 32 so that the hub is selectably movable between a stowed position with intake portion 28 within hull 14 and a deployed position with the intake portion extending away from the bottom portion 18 of the hull.

Figure 4:
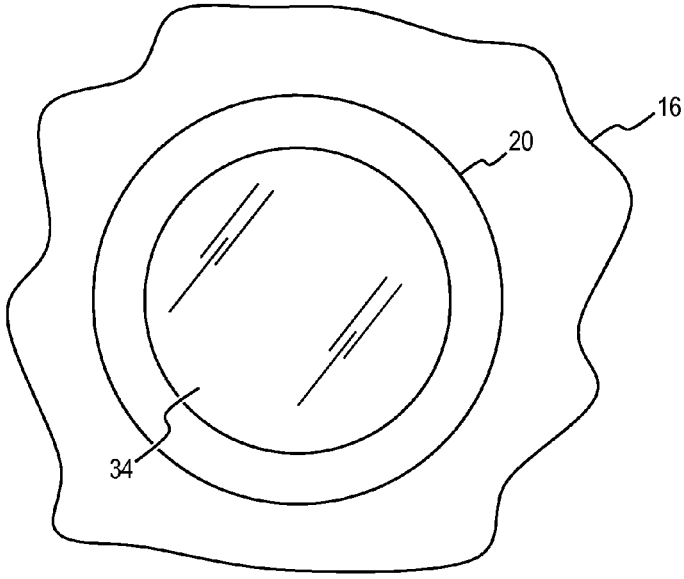
FIG. 4 shows a closure for a port opening of the system of FIG. 1 according to an embodiment of the present invention.

Port opening 20 is preferably located above a water WL (FIG. 1) of watercraft 12 and is sized and shaped to emit a stream of water supplied by duct 24. Accordingly, port opening 20 may be formed in any shape suitable for emitting the water stream and conforming to the design of watercraft 12 including, without limitation, circular, oval, square, rectangular and octagonal shapes. In some embodiments port opening 20 may be shaped to conform to styling and/or design features of watercraft 14 in order to disguise or visually obscure the port opening. Port opening 20 may further include a biased closure 34, shown generally in FIG. 4, to close off the opening when braking system 10 is not being used in order to prevent the buildup of debris and deter nesting insects. When braking system 10 is operated to slow or stop watercraft 12 closure 34 is urged away from port opening 20 against the force of the biasing element by a stream of water supplied by duct 24.

Water inlet 22 is formed in bottom 18 of hull 14 and is sized and shaped to accommodate hub 26. Water inlet 22 may be made integral with hull 14. Alternatively, water inlet 22 may be made as a separate piece and joined to an open portion of hull 14.

Duct 24 extends between water inlet 22 and port opening 20. Accordingly, duct 24 may be made in any size and shape suitable for carrying a stream of water from water inlet 22 to port opening 20. In some embodiments, for example, duct 24 may be circular while in other embodiments the duct may be rectangular or square. In addition, duct 24 may be made as a separate piece and joined to hull 14, or may be made integral to the hull.

Duct 24 may have a uniform cross-sectional area along its length or, in some embodiments, may be tapered as shown in FIG. 1 from a larger cross-sectional area at an input 36 of the duct to a smaller cross-sectional area at port opening 20 in order to concentrate water flowing in the duct into a higher-pressure stream. Input 36 is preferably shaped to conform to the shape of output 30 of hub 26 such as, without limitation, circular, oval, square, rectangular and octagonal shapes. Input 36 may include a flexible seal 38 as shown in FIG. 3 to reduce or prevent water leakage between duct 24 and hub 26 when the hub is in a fully-deployed condition.

Duct 24 may be made from any material or combination of materials suitable for the expected structural load and environment for braking system 10 and watercraft 12, including metal, composites and engineered plastics. In addition, duct 24 may be formed in any conventional manner, such as by molding, casting, machining, cold forming and forging. Duct 24 may be finished in any conventional manner, such as painting, powder coating, plating, or may be unfinished.

Figure 5:
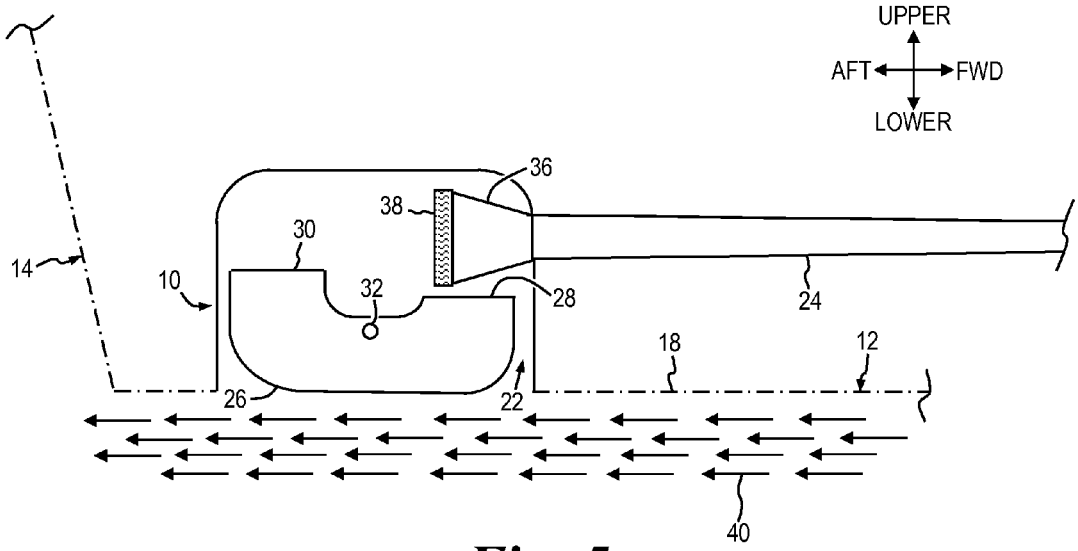
FIG. 5 is a diagram showing the braking system of FIG. 1 in a stowed condition.
Figure 6:
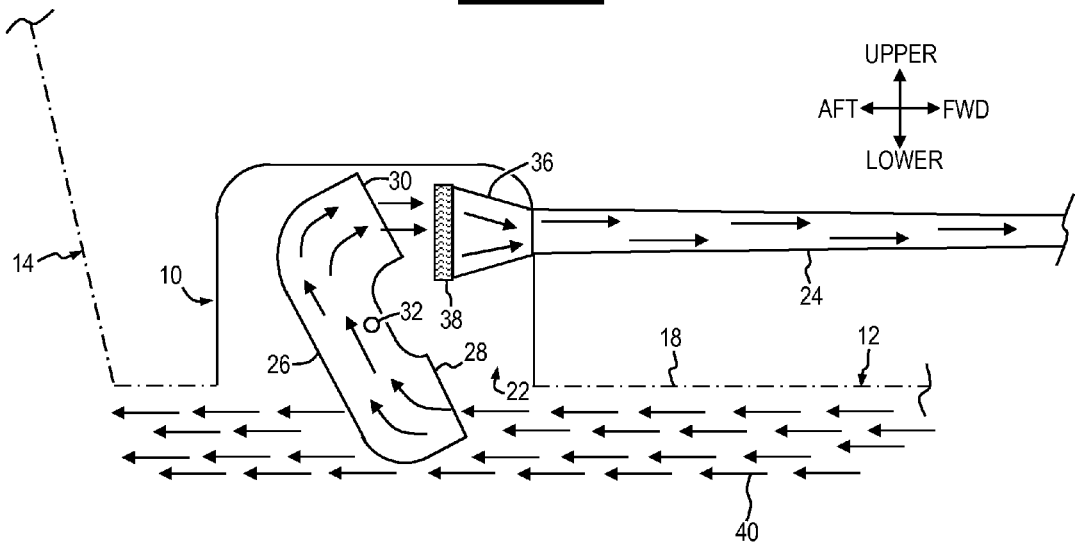
FIG. 6 is a diagram showing the braking system of FIG. 1 in a partially deployed condition.
Figure 7:
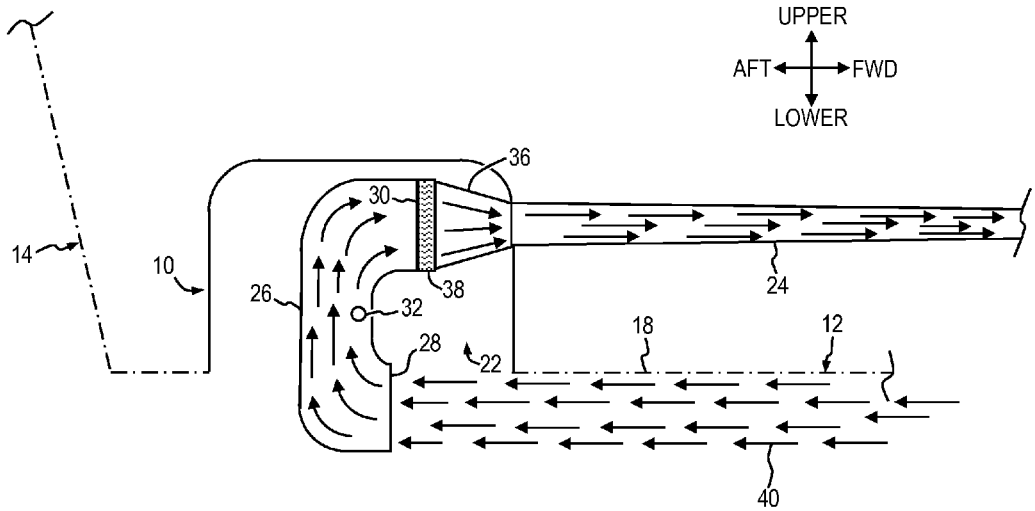
FIG. 7 is a diagram showing the braking system of FIG. 1 in a fully deployed condition.

Hub 26 is generally U-shaped and includes intake portion 28 and output portion 30. Intake portion 28 extends into water 40 (FIGS. 5 through 7) when hub 26 is in a deployed condition, as shown in FIGS. 6 and 7. Intake portion 40 may be formed in any shape suitable for receiving water 40 including, without limitation, circular, oval, square, rectangular and octagonal shapes. Output portion 30 is proximate duct 24 and contacts input 36 of the duct when hub 26 is in a fully-deployed condition. Output portion 30 is preferably shaped to conform to the shape of input 36 of duct 24 such as, without limitation, circular, oval, square, rectangular and octagonal shapes.

Hub 26 may be made from any material or combination of materials suitable for the expected structural load and environment for braking system 10 and watercraft 12, including metal, composites and engineered plastics. In addition, hub 26 may be formed in any conventional manner, such as by molding, casting, machining, cold forming and forging. Hub 26 may be finished in any conventional manner, such as painting, powder coating, plating, or may be unfinished. In addition, hub 26 may include a seal 38 at output portion 30 in addition to or instead of the previously discussed seal at input 36 of duct 24.

Hub 26 is pivotably attached to hull with pivot rod 32 so that the hub is rotatably and selectably movable between a stowed position (FIG. 5) with intake portion 28 within hull 14 and a fully-deployed position (FIG. 7) with the intake portion extending away from the bottom portion 18 of the hull. Hub 26 may likewise be positionable at any partially-deployed position, such as shown in FIG. 6, between the stowed and fully-deployed positions.

Figure 8:
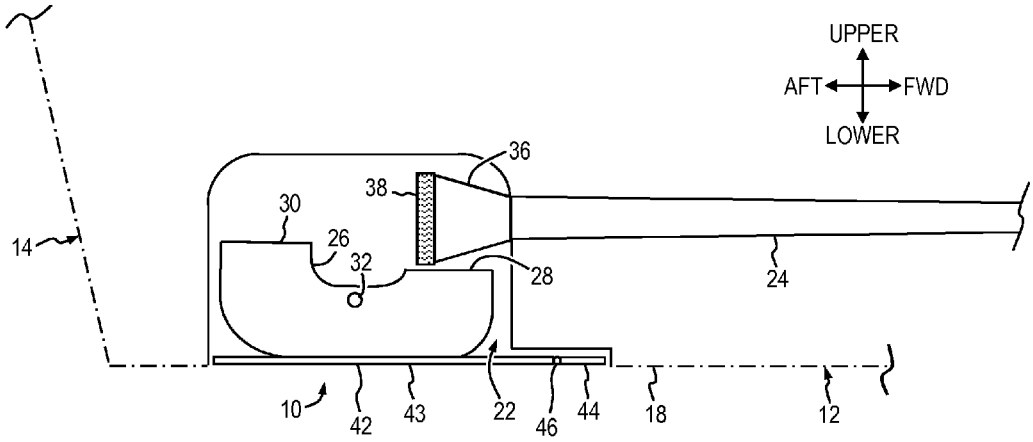
FIG. 8 is a diagram of the braking system of FIG. 1 with an optional brake board according to an embodiment of the present invention.

With reference to FIG. 8, in some embodiments of the present invention hub 26 may optionally include a generally rigid braking board 42 sized and shaped to add a predetermined amount of drag to watercraft 12 in water 40 (FIGS. 5 through 7) when the hub is in a deployed condition. Braking board 42 may be made separately and joined to an aft portion of hub 26, or may be made integral with the hub. In addition, braking board 42 may include an upper portion 43 and a lower flexible portion 44 made from a flexible material such as plastic or hard rubber that is rigidly attached to the braking board. Alternatively, flexible portion 44 may be made from a flexible or rigid material that is in turn flexibly attached to braking board 42 with a flexible coupling 46, such as a "living hinge" or with a biasing element such as a torsion spring.

Figure 9:
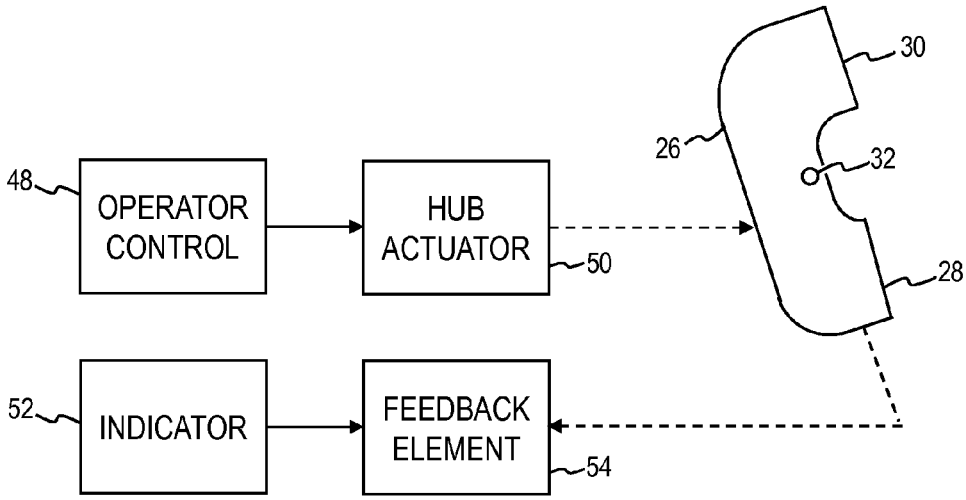
FIG. 9 is a block diagram of a control portion of the braking system of FIG. 1.

With reference now to FIG. 9, braking system 10 may further include an operator control 48 to operate the braking system. Operator control 48 may comprise any type of proportional control input device that is movable about a predetermined range and generates a proportional mechanical, pneumatic or electrical control signal, opposing extremes of the range of motion representing the BRAKE OFF or stowed (FIG. 5) and the BRAKE ON or fully-deployed (FIG. 7) conditions of hub 26. Example proportional operator controls include, without limitation, rotatable or pivotable hand controls, valves, potentiometers, encoders and foot pedals. Alternatively, binary-type switches, valves and relays may be utilized to provide one or both of a BRAKE ON and a BRAKE OFF signal to braking system 10.

Braking system 10 may further include one or more hub actuators 50 (FIGS. 2, 10) to receive the control signal generated by operator control 48 and generate a corresponding physical output configured to move hub 26. For example, a BRAKE OFF control signal from operator control 48 may be interpreted by hub actuator 50 as a command to move hub 26 to its stowed condition (FIG. 5). Likewise, a BRAKE ON control signal may be interpreted by hub actuator 50 as a command to move hub 26 to its fully-deployed position (FIG. 7). If a proportional control signal is generated by operator control 48 hub actuator 50 may be configured to move hub 26 to a finite or infinite range of positions corresponding to the proportional control signal, the positions ranging between and including the stowed and fully-deployed positions of the hub. Hub actuator 50 may be any type of actuator now known or later invented including, without limitation, a mechanical push-pull rod, Bowden cable, electric actuator, hydraulic actuator, and pneumatic actuator.

Hub 26 is preferably in the stowed condition (FIG. 5) when braking system 10 is not being operated to slow or stop watercraft 12. Accordingly, either or both of operator control 48 and hub actuator 50 may be biased to move hub 26 to the stowed condition. For example, operator control 26 may include a biasing element (not shown) that moves an operator handle or pedal to a predetermined (BRAKE OFF) extreme when not being operated by an operator. Likewise, hub actuator 50 may be configured such that hub 26 is moved to the stowed position when no command signal is being provided to the hub actuator from operator control 48.

With reference to FIGS. 1 through 9 together, in operation watercraft 12 may be operated upon water 40 such that the watercraft is in motion with respect to the water. When an operator of watercraft 12 desires to slow or stop the watercraft faster than is normally accomplished by dethrottling alone the operator engages and operates control 48. Control 48 provides a command signal to hub actuator 50, which interprets the command signal and moves hub 26 out of the stowed position (FIG. 5). A portion of water 40 flowing past hub 26 is diverted into intake portion 28 of the hub when the hub is thus deployed (FIGS. 6 and 7), the diverted water being directed out of output portion 30 of the hub and into duct 24. The diverted water 40 is urged at high pressure through duct 24 and out of port opening 20 by the flowing water. Watercraft 12 is braked by drag induced upon hull 14 in water 40 by intake 28 of the deployed hub 26 extending into the flowing water and by the diverted water urged through duct 24 and out of port opening 20. When braking is no longer desired the operator moves or releases the operator control 48, which may be biased toward a BRAKE OFF condition, thereby generating a command signal interpreted by hub actuator 50 as a command to move hub 26 to the stowed condition (FIG. 5).

In some embodiments braking system 10 may optionally include an indicator 52 to provide a user with a visually perceivable indication of the status of the braking system. With continued reference to FIG. 9, a feedback element 54 is mechanically coupled to hub 26 and provides an electrical signal corresponding to the position of the hub. The electrical signal is coupled to indicator 52, which receives the electrical signal and transforms it into a corresponding visually perceivable indication of the status of the braking system. Feedback element 54 may be, without limitation, any combination of a limit switch, a potentiometer, and an encoder. Indicator 52 may be a meter, a gauge, an electronic display and a light, among other visually perceivable devices.

Figure 10:
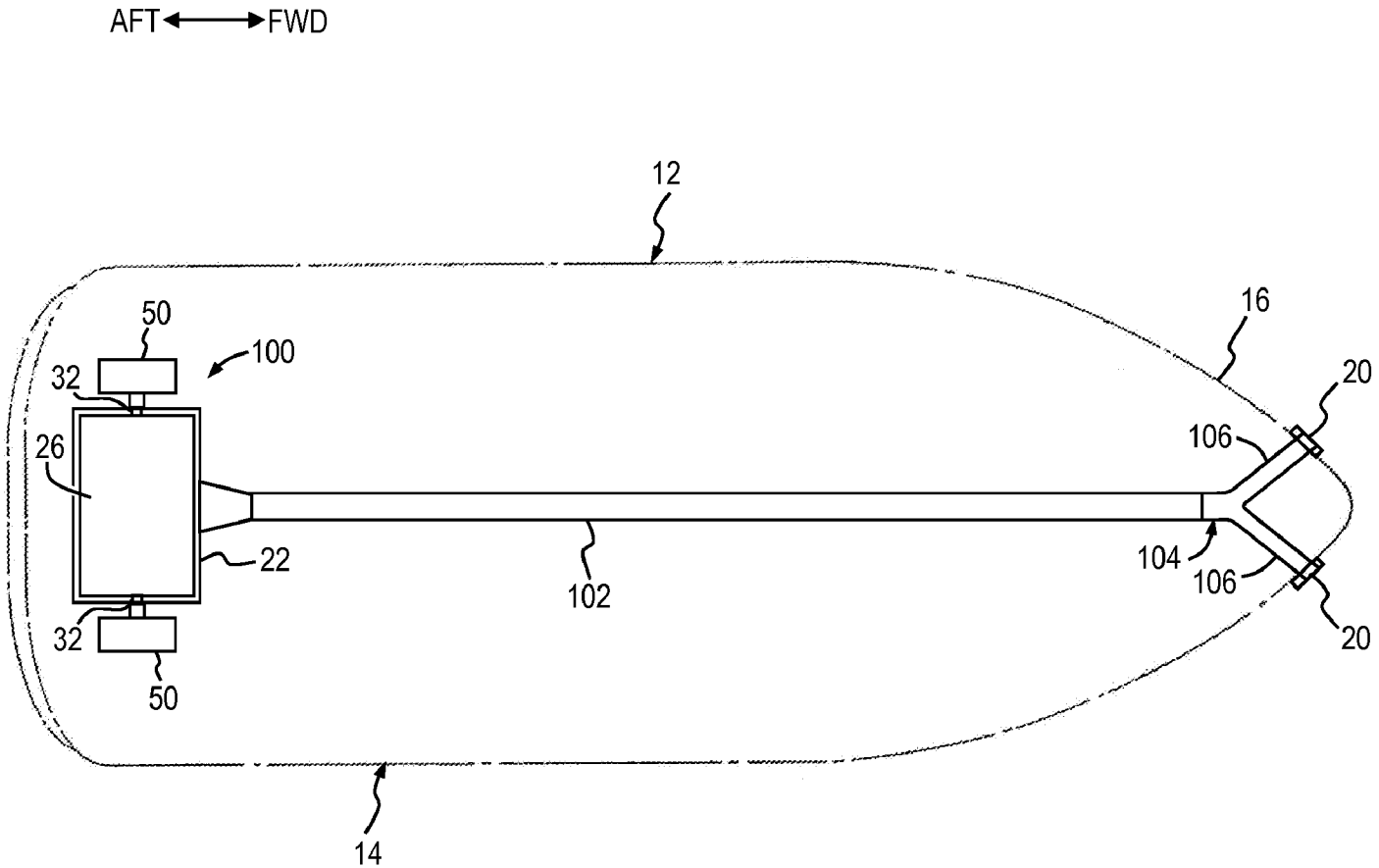
FIG. 10 is a top plan view of a braking system for a watercraft according to another embodiment of the present invention.

The general arrangement of a braking system 100 for a watercraft 12 is shown in FIG. 10 according to an alternate embodiment of the present invention. A pair of port openings 20 are formed in bow portion 16 of watercraft 12. In addition, a water inlet 22 is formed in the bottom portion 18 of the hull 14. A single duct 102 extends from water inlet 22 and is coupled to a Y-shaped duct 104. A pair of duct portions 106 extending from Y-shaped duct 104 divide duct 102, each of the duct portions being connected to a corresponding port opening 20. Braking system 100 is otherwise similar to braking system 10.

Figure 12:
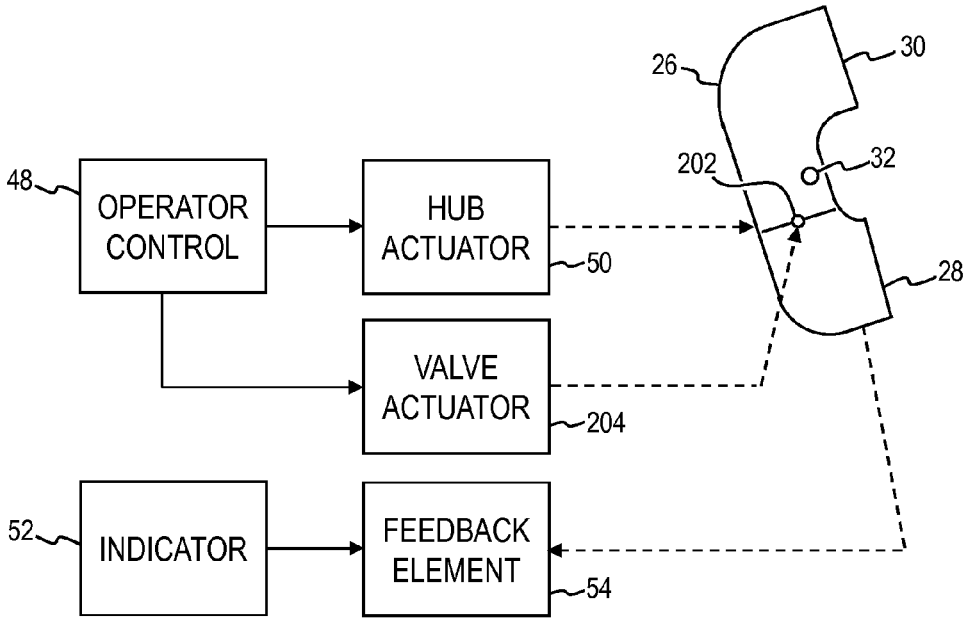
FIG. 12 is a block diagram of a control portion of the braking system of FIG. 11.
Figure 11:
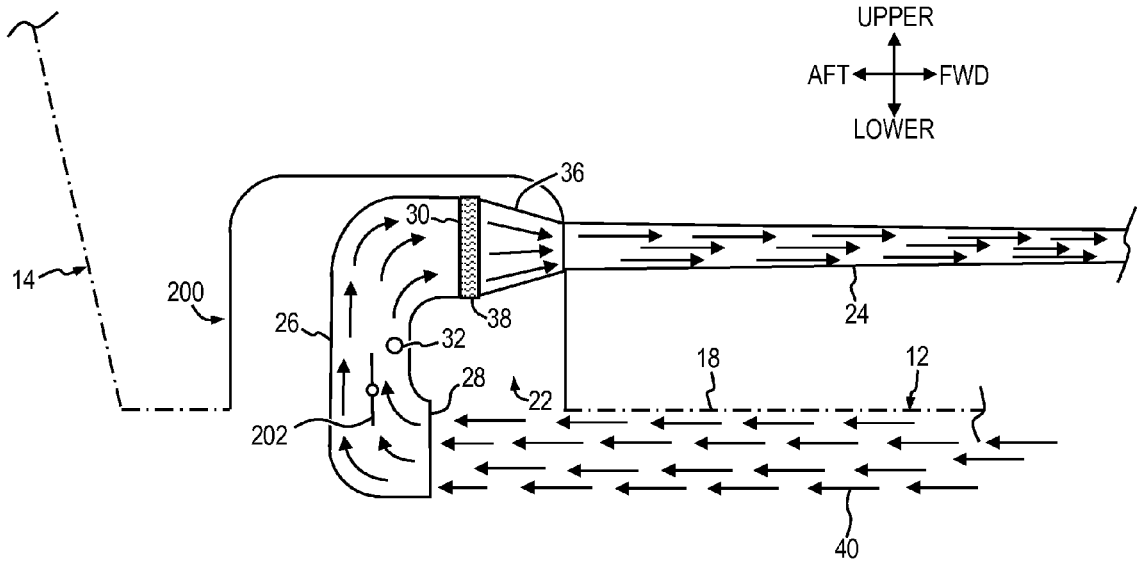
FIG. 11 is a diagram of a braking system according to yet another embodiment of the present invention.

The general arrangement of a braking system 200 is shown in FIGS. 11 and 12 according to still another embodiment of the present invention. In this embodiment hub 26 includes a hub valve 202 operated by a valve actuator 204. In a stowed condition braking system 200 is similar to the stowed condition of braking system 10, shown in FIG. 5. In a deployed condition braking system 200 is similar to the fully-deployed condition of braking system 10, shown in FIG. 7. In the deployed condition of hub 26 water flow through the hub and duct 24 is controlled by the position of hub valve 202, which is in turn controlled by valve actuator 204.

Valve actuator 204 is similar to hub actuator 50. Valve actuator 204 receives a control signal generated by operator control 48 and generates a corresponding physical output configured to move hub valve 202. For example, a BRAKE OFF control signal from operator control 48 may be interpreted by hub actuator 50 as a command to move hub valve 202 to an orientation that presents maximum resistance to water flow through hub 26, that is, generally perpendicular to the water flow (FIG. 12). Likewise, a BRAKE ON control signal may be interpreted by valve actuator 204 as a command to move hub valve 202 to an orientation that presents minimum resistance to water flow through hub 26, that is, generally parallel to the water flow (FIG. 11). If a proportional control signal is generated by operator control 48 hub actuator 50 provides a command signal to hub actuator 50, which interprets the command signal and moves hub 26 out of the stowed position (FIG. 5) to a fully-deployed position (FIG. 7). Likewise, valve actuator 204 may be configured to move hub valve 202 to a finite or infinite range of positions corresponding to the proportional control signal, the positions ranging between and including the aforementioned parallel and perpendicular positions with respect to the flow of water through hub 26. Valve actuator 204 may be any type of actuator now known or later invented including, without limitation, a mechanical push-pull rod, Bowden cable, electric actuator, hydraulic actuator, and pneumatic actuator.

Braking system 200 is otherwise similar to braking system 10.

While this invention has been shown and described with respect to a detailed embodiment thereof, it will be understood by those skilled in the art that changes in form and detail thereof may be made without departing from the scope of the claims of the invention.

What is claimed is:

1. A braking system for a watercraft moving upon a body of water, comprising:

a hull having a bow portion and a bottom portion;

a port opening in the bow portion of the hull;

a water inlet in the bottom portion of the hull;

a duct extending between the water inlet and the port opening; and a generally U-shaped hub having an intake portion and an output portion, the output portion being proximate the duct, the hub being selectably movable between a stowed position with the intake portion within the hull and a deployed position with the intake portion extending into the body of water and away from the bottom portion of the hull, wherein the intake portion of the hub, when deployed, diverts water into the intake portion of the hub, to the output portion of the hub, and into the duct, the diverted water further being urged through the duct and out of the port opening, the moving watercraft being braked by drag induced upon the hull by the hub when deployed, the hub extending into the body of water and by the diverted water urged out of the port opening.

2. The braking system of claim 1, further comprising a braking board coupled to the hub, the braking board being movable in common with the hub.

3. The braking system of claim 2 wherein the braking board further includes an upper portion and a lower portion, the lower portion being flexible with respect to the upper portion.

4. The braking system of claim 1, further including a seal between the output portion of the hub and the duct.

5. The braking system of claim 1, further including a remotely-located operator control for moving the hub between the stowed and deployed positions.

6. The braking system of claim 5 wherein the remotely-located operator control is one of a hand control and a foot-operated pedal.

7. The braking system of claim 5, further comprising a hub actuator coupled between the operator control and the hub.

8. The braking system of claim 7 wherein the hub actuator is one of a Bowden cable, push-pull rod, hydraulic actuator, pneumatic actuator and electric actuator.

9. The braking system of claim 5 wherein movement of the hub between the stowed and deployed positions is proportional to corresponding movement of the operator control.

10. The braking system of claim 1, further including a biased closure closing off the port opening, the closure being urged away from the port opening by the diverted water being urged out of the port opening.

11. The braking system of claim 1, further comprising:

a pair of port openings, the pair of port openings being formed in opposing faces of the bow; and a duct extending between each port opening and the water inlet.

12. The braking system of claim 1 wherein the cross-sectional area of the duct tapers from a larger cross-sectional area proximate the water inlet to a smaller cross-sectional area proximate the port opening.

13. The braking system of claim 1 wherein the hub moves between the stowed and deployed positions rotationally, pivoting about a pivot axis.

14. The braking system of claim 1 wherein the hub further includes a hub valve.

15. The braking system of claim 14, further comprising:

an operator control; and a valve actuator coupled between the operator control and the hub valve.

16. A braking system for a watercraft moving upon a body of water, comprising:

a hull having a bow portion and a bottom portion;

a port opening in the bow portion of the hull;

a water inlet in the bottom portion of the hull;

a duct extending between the water inlet and the port opening;

a generally U-shaped hub having an intake portion and an output portion, the output portion being proximate the duct;

a braking board coupled to the hub, the braking board being movable in common with the hub; and a remotely-located operator control for moving the hub between the stowed and deployed positions, the hub being selectably movable between a stowed position with the intake portion within the hull and a deployed position with the intake portion extending into the body of water and away from the bottom portion of the hull, wherein the intake portion of the hub, when deployed, diverts water into the intake portion of the hub, to the output portion of the hub, and into the duct, the diverted water further being urged through the duct and out of the port opening, the moving watercraft being braked by drag induced upon the hull by the hub when deployed, the hub extending into the body of water and by the diverted water urged out of the port opening.

17. The braking system of claim 16, further including a seal between the output portion of the hub and the duct.

18. The braking system of claim 16, further comprising a hub actuator coupled between the operator control and the hub.

19. The braking system of claim 16 wherein movement of the hub between the stowed and deployed positions is proportional to corresponding movement of the operator control.

20. A method for braking a watercraft moving upon a body of water, comprising the steps of:

providing a hull having a bow portion and a bottom portion;

forming a port opening in the bow portion of the hull;

forming a water inlet in the bottom portion of the hull;

extending a duct between the water inlet and the port opening; and providing a generally U-shaped hub having an intake portion and an output portion, the output portion being proximate the duct, the hub being selectably movable between a stowed position with the intake portion within the hull and a deployed position with the intake portion extending into the body of water and away from the bottom portion of the hull, wherein the intake portion of the hub, when deployed, diverts water into the intake portion of the hub, to the output portion of the hub, and into the duct, the diverted water further being urged through the duct and out of the port opening, the moving watercraft being braked by drag induced upon the hull by the hub when deployed, the hub extending into the body of water and by the diverted water urged out of the port opening.

* * * * *